US009216512B2

(12) United States Patent
Kawai et al.

(10) Patent No.: US 9,216,512 B2
(45) Date of Patent: Dec. 22, 2015

(54) SCISSORS

(75) Inventors: Shinnosuke Kawai, Osaka (JP); Masanori Ando, Osaka (JP); Mitsuhiro Takasaki, Osaka (JP)

(73) Assignee: ENGINEER INC., Osaka (JP)

( * ) Notice: Subject to any disclaimer, the term of this patent is extended or adjusted under 35 U.S.C. 154(b) by 108 days.

(21) Appl. No.: 14/112,738

(22) PCT Filed: Jun. 13, 2012

(86) PCT No.: PCT/JP2012/065095

§ 371 (c)(1),
(2), (4) Date: Oct. 18, 2013

(87) PCT Pub. No.: WO2012/173135

PCT Pub. Date: Dec. 20, 2012

(65) Prior Publication Data

US 2014/0082946 A1 Mar. 27, 2014

(30) Foreign Application Priority Data

Jun. 13, 2011 (JP) ..... 2011-131037

(51) Int. Cl.
*B26B 13/20* (2006.01)

(52) U.S. Cl.
CPC ..... *B26B 13/20* (2013.01)

(58) Field of Classification Search
CPC ..... B26B 13/00; B26B 13/12; B26B 13/20; B26B 1/10; B26B 13/14; B26B 13/16; B26B 13/18; B26B 27/007
USPC ..... 30/232–262; D8/57; 7/133–136
See application file for complete search history.

(56) References Cited

U.S. PATENT DOCUMENTS

| | | | | | |
|---|---|---|---|---|---|
| 1,666,968 | A | * | 4/1928 | Newton | 30/226 |
| D206,311 | S | * | 11/1966 | Eizenburg | D24/143 |
| D242,425 | S | * | 11/1976 | Backstrom | D8/57 |
| D310,469 | S | * | 9/1990 | Dressler | D8/57 |
| D409,465 | S | * | 5/1999 | Olix et al. | D8/57 |
| 5,964,033 | A | * | 10/1999 | Wolf | 30/28 |
| D429,614 | S | * | 8/2000 | Ploeger | D8/57 |
| 6,131,223 | A | * | 10/2000 | Rehkemper | B26B 13/00 7/135 |
| D483,635 | S | * | 12/2003 | Silver et al. | D8/57 |
| 6,739,057 | B2 | * | 5/2004 | Schallenberg | B26B 13/12 16/446 |
| 7,087,070 | B2 | * | 8/2006 | Flipo | A61B 10/06 606/205 |

(Continued)

FOREIGN PATENT DOCUMENTS

| | | | |
|---|---|---|---|
| JP | 1977-099585 | U | 7/1977 |
| JP | 2004-073310 | A | 3/2004 |

*Primary Examiner* — Ned Landrum
*Assistant Examiner* — Richard Crosby, Jr.
(74) *Attorney, Agent, or Firm* — Muncy, Geissler, Olds & Lowe, P.C.

(57) ABSTRACT

Provided are scissors with excellent safety that can more reliably prevent finger pinch when being closed. In the present invention, finger pinch prevention guards 20*a*, 20*b* for preventing fingertips from entering the opposing inner surfaces 10*a*, 10*b* side from above or below are formed on left and right operation portions 7*a*, 7*b*. This can prevent user's fingertips from reaching the opposing inner surfaces (10*a*, 10*b*) by setting the user's fingertips inserted into finger placing holes (6*a*, 6*b*) along upper and lower surfaces of the finger pinch prevention guards 20*a*, 20*b*. Consequently, when the operation portions 7*a*, 7*b* are in the closed position, the fingertips are prevented from being pinched between the opposing inner surfaces 10*a*, 10*b* so as not to cause finger pinch.

12 Claims, 9 Drawing Sheets

(56) References Cited

U.S. PATENT DOCUMENTS

| | | | | |
|---|---|---|---|---|
| 7,458,160 | B2 * | 12/2008 | Escobar et al. | 30/232 |
| 8,272,300 | B2 * | 9/2012 | Fournier | 81/313 |
| 8,516,707 | B2 * | 8/2013 | Castley et al. | 30/232 |
| D703,507 | S * | 4/2014 | Bhasin | D8/57 |
| D722,482 | S * | 2/2015 | McLean | D8/57 |
| 8,959,777 | B2 * | 2/2015 | Forman et al. | 30/146 |
| 2002/0095796 | A1 * | 7/2002 | Whitehall | B26B 13/12 30/232 |
| 2004/0205897 | A1 * | 10/2004 | Hartranft et al. | 7/107 |
| 2007/0017104 | A1 * | 1/2007 | Hasegawa | 30/232 |
| 2007/0144015 | A1 * | 6/2007 | Peterson et al. | 30/262 |
| 2008/0028621 | A1 * | 2/2008 | Hasegawa | 30/232 |
| 2008/0172886 | A1 * | 7/2008 | Jun | B26B 13/20 30/232 |
| 2010/0293794 | A1 * | 11/2010 | Shan | 30/261 |
| 2014/0293794 | A1 * | 10/2014 | Zhong et al. | 370/235.1 |
| 2014/0360025 | A1 * | 12/2014 | Hyma et al. | 30/254 |

* cited by examiner 27
6b
7b
13b
26
25
16b
3
10b
4a
12b
11b
21b
20b
BP
5
BP
11a
15a
21a
20a
10a
4b
12a
3
25
26
13a
6a
7a
27

23
7a
7b
20b
10b
11a
FRONT
LEFT
RIGHT
REAR
25
25
21b
21a
16b
3
10a
20a
12a
23
12b
SG

Fig. 7C2
top view right-side view
Fig. 7C1
front view left-side view
Fig. 7C4
bottom view back view
Fig. 7C3
C-C section
2
8
9
4a
4b
5
6a
6b
7a
7b
12a
12b
13a
13b
20a
20b
25
C

SCISSORS

TECHNICAL FIELD

The present invention relates to scissors, and particularly relates to a technique for preventing finger pinch.

BACKGROUND ART

As a method for preventing finger pinch in the field of scissors, as described in Patent Document 1 for example, providing a protrusion on an opposing inner surface of an operation portion is publicly known. In Patent Document 1, a protrusion is provided on an inner surface of one operation portion opposite to the other operation portion so that the both operation portions are not abutted on a line or a surface, thereby preventing fingertips from being pinched between the both operation portions. A similar protrusion is also seen in Patent Document 2 relating to an earlier application of Patent Document 1. A similar protrusion is also seen in Japanese scissors and scissors for hairdressing.

PRIOR ART DOCUMENTS

Patent Documents

Patent Document 1: JP 2004-73310 A (paragraph 0022)
Patent Document 2: JP S52-099585 Y

SUMMARY OF THE INVENTION

Problem to be Solved by the Invention

As described above, in scissors in which a protrusion is used for restricting a closing operation limit of both operation portions so that the both operation portions are not abutted on a line or a surface, the protrusion abuts on the operation portion to form a gap between the both operation portions, and the presence of such a gap effectively prevents fingertips or the like from being pinched between the both operation portions. However, there still remains a fear that fingertips or the like are pinched between the protrusion and the opposing inner surface of the operation portion, and it is impossible to fundamentally prevent finger pinch. Such inconvenience is especially remarkable in scissors as a work tool which performs cutting a workpiece with great force, specifically scissors used for cutting metal plates, resin plates, ropes, or cables, and the like. That is, since great closing operation force is required to cut metal plates or the like, a user closes the operation portions with the fingertips entered deeply into finger placing holes of the operation portions. Accordingly, the fingertips which have passed through the finger placing holes easily reach the opposing inner surfaces of operation portions, and if the fingertip is placed on the protrusion, the fingertip is pinched between the protrusion and the opposing inner surface of the operation portion.

The present invention has been made to solve the above-described problem which conventional scissors have, and an object thereof is to provide scissors with excellent safety which can more reliably prevent finger pinch during closing operation.

Means for Solving the Problem

As illustrated in FIG. 1, the scissors of the present invention includes: a pair of upper and lower scissor pieces 4*a*, 4*b* having cutting portions 2 at front ends thereof and handle portions 3 at rear ends thereof; a rotation center shaft 5 provided in center portions in front and rear directions of the scissor pieces 4*a*, 4*b* so as to crossingly and swingably support the scissor pieces 4*a*, 4*b* with each other, the scissor pieces 4*a*, 4*b* being assembled in an X-shape; and a pair of left and right operation portions 7*a*, 7*b* attached to the handle portions 3 of the scissor pieces 4*a*, 4*b* and having finger placing holes 6*a*, 6*b* for placing fingertips of a user, wherein, with the fingertips placed on the finger placing holes 6*a*, 6*b*, the cutting portions 2 are opened and closed by opening and closing the both operation portions 7*a*, 7*b* about the rotation center shaft 5 between an open position in which opposing inner surfaces 10*a*, 10*b* of the both operation portions 7*a*, 7*b* are apart from each other and a closed position in which the opposing inner surfaces 10*a*, 10*b* of the both operation portions 7*a*, 7*b* are close to each other.

Furthermore, finger pinch prevention guards 20*a*, 20*b* are formed on an upper end of one operation portion 7*a* on left or right and on a lower end of the other operation portion 7*b* so as to extend in a cantilever manner to an inside in left and right directions from the upper end and the lower end, thereby preventing the fingertips from entering the opposing inner surfaces 10*a*, 10*b* side from above or below by being overlapped with an upper end surface 16*b* or a lower end surface 16*a* of the operation portions 7*b*, 7*a* opposed thereto when the both operation portions 7*b*, 7*a* are in a closed position. An opposing gap is formed between the finger pinch prevention guards 20*a*, 20*b* and the upper end surface 16*b* and the lower end surface 16*a* of the operation portions 7*b*, 7*a* opposed to the finger pinch prevention guards 20*a*, 20*b* when the both operation portions 7*a*, 7*b* are in the closed position. Due to such an opposing gap, the finger pinch prevention guards 20*a*, 20*b* and the upper end surface 16*b* and the lower end surface 16*a* of the operation portions 7*b*, 7*a* opposed to these finger pinch prevention guards 20*a*, 20*b* do not make contact with each other when the both operation portions 7*a*, 7*b* are in the closed position.

As illustrated in FIGS. 4A and 4B, it is preferable to employ a mode in which the upper end surface 16*b* and the lower end surface 16*a* of the operation portions 7*b*, 7*a* opposed to the finger pinch prevention guards 20*a*, 20*b* in the closed position are flat surfaces.

As illustrated in FIG. 1 and the like, it is preferable to employ a mode in which anti-slipping recess and projection portions 25 are formed on base end portions of the operation portions 7*a*, 7*b* of the finger pinch prevention guards 20*a*, 20*b*.

Protruding portions 21*a*, 21*b* for restricting a proximity limit of the both operation portions 7*a*, 7*b* in the closed position are formed on one or both of the opposing inner surfaces 10*a*, 10*b* of the both operation portions 7*a*, 7*b*. A center gap 23 is formed between the both operation portions 7*a*, 7*b* in the closed position by the protruding portions 21*a*, 21*b* making contact with each other or by tip ends of the protruding portions 21*a*, 21*b* making contact with the opposing inner surfaces. The finger pinch prevention guards 20*a*, 20*b* are capable of preventing the fingertips from entering the center gap 23 by from above or below when the both operation portions 7*a*, 7*b* are in the closed position.

Effects of the Invention

In the scissors according to the present invention, the finger pinch prevention guards 20*a*, 20*b* for preventing fingertips from entering the opposing inner surfaces 10*a*, 10*b* side from above or below are formed on both left and right operation portions 7*a*, 7*b*. More specifically, such finger pinch prevention guards 20*a*, 20*b* are formed on the upper end of one operation portion 7*a* on left or right and on the lower end of the other operation portion 7*b* so as to extend in a cantilever manner to the inside in the left and right directions from the upper end and the lower end. The finger pinch prevention guards 20*a*, 20*b* overlap with the upper end surface 16*b* or the lower end surface 16*a* of the operation portions 7*b*, 7*a* opposed thereto so as to prevent fingertips from entering the opposing inner surfaces 10*a*, 10*b* side from above or below when the operation portions 7*a*, 7*b* are in the closed position.

According to this configuration, fingertips placed on the finger placing holes 6*a*, 6*b* can be set along the finger pinch prevention guards 20*a*, 20*b*. That is, as shown in FIG. 8, when operating this type of scissors, a middle finger 33 and a third finger 34 are usually inserted into the finger placing hole 6*a* of one operation portion 7*a*, and a thumb 31 is inserted into the finger placing hole 6*b* of the other operation portion 7*b*. When the finger pinch prevention guards 20*a*, 20*b* are provided at the operation portions 7*a*, 7*b* as in the present invention, bending angles at the first joints of the middle finger 33 and the third finger 34 are restricted by the finger pinch prevention guards 20*a*, 20*b*, enabling fingertips of the middle finger 33 and the third finger 34 to be set along the upper and lower outer surface of the finger pinch prevention guards 20*a*, 20*b*. This can prevent fingertips of the middle finger 33 and the third finger 34 which are inserted deeply into the finger placing holes 6*a*, 6*b* from being bent substantially at right angles at the first joints and reaching the opposing inner surfaces 10*a*, 10*b*. Therefore, when the operation portions 7*a*, 7*b* are in the closed position, the fingertips of the middle finger 33 and the third finger 34 can be reliably prevented from being pinched between the opposing inner surfaces 10*a*, 10*b* of the operation portions 7*a*, 7*b*. Note that, the above middle finger 33 or the like is an example of a finger to be inserted into the finger placing hole 6*a* or the like, and the finger to be inserted into the finger placing hole 6*a* differs depending on the length and the size of fingers of a user.

Further, when the finger pinch prevention guards 20*a*, 20*b* are formed at the both operation portions 7*a*, 7*b*, finger pinch can be prevented even if the middle finger 33 and the third finger 34 are inserted into the finger placing holes 6*a*, 6*b* of either of the operation portions 7*a*, 7*b*, and scissors 1 with excellent usability can be obtained. Additionally, the scissors 1 shown in the embodiment of FIG. 1 and the like are right-handed scissors, and the arrangement position of the finger pinch prevention guards 20*a*, 20*b* is turned upside down in the case of left-handed scissors.

In the closed position, the upper end surface 16*b* and the lower end surface 16*a* of the operation portions 7*b*, 7*a* opposite to the finger pinch prevention guards 20*a*, 20*b* are preferably flat surfaces. This is because, if a recessed portion for receiving the finger pinch prevention guards 20*a*, 20*b* is formed in a recessed manner on the upper end surface 16*b* or the lower end surface 16*a* of the operation portions 7*a*, 7*b*, for example, fingertips may be pinched between the side surface which defines the recessed portion and the finger pinch prevention guards 20*a*, 20*b*. On the other hand, as in the present invention, when the upper end surface 16*b* and the lower end surface 16*a* of the operation portions 7*b*, 7*a* opposite to the finger pinch prevention guards 20*a*, 20*b* in the closed position are flat surfaces, such a problem that fingertips are pinched between the side surface which defines the recessed portion and the finger pinch prevention guards 20*a*, 20*b* as described above does not occur, and finger pinch can be prevented more reliably.

When the anti-slipping recess and projection portions 25 are formed on the base end portions of the operation portions 7*a*, 7*b* of the finger pinch prevention guards 20*a*, 20*b*, by placing fingertips of the middle finger 33 and the like on the recess and projection portions 25, the state of the middle finger 33 and the like being inserted into the finger placing holes 6*a*, 6*b* can be more reliably maintained. Consequently, the fingertips can be prevented from reaching the opposing inner surfaces 10*a*, 10*b* by a careless sliding movement of the middle finger 33 and the like and the fingertips can be prevented from being pinched between the opposing inner surfaces 10*a*, 10*b* or the protruding portions 21*a*, 21*b*.

The protruding portions 21*a*, 21*b* for restricting the proximity limit of the both operation portions 7*a*, 7*b* in the closed position are formed on one or both of the opposing inner surfaces 10*a*, 10*b* of the both operation portions 7*a*, 7*b*. The center gap 23 is formed between the both operation portions 7*a*, 7*b* in the closed position by the protruding portions 21*a*, 21*b* making contact with each other or by tip ends of the protruding portions 21*a*, 21*b* making contact with the opposing inner surfaces 10*a*, 10*b*. It is preferable that the finger pinch prevention guards 20*a*, 20*b* prevent the fingertips from entering into the center gap 23 from above or below when the both operation portions 7*a*, 7*b* are in the closed position. This can more reliably prevent finger pinch, because, even if the fingertips carelessly enter the opposing inner surfaces 10*a*, 10*b* side beyond the finger pinch prevention guards 20*a*, 20*b*, the presence of the center gap 23 formed between the opposing inner surfaces 10*a*, 10*b* can prevent the finger pinch between the opposing inner surfaces 10*a*, 10*b*.

BRIEF DESCRIPTION OF THE DRAWINGS

FIGS. 7A to 7D are a back view, a left-side view, a front view, and a right-side view of the scissors according to the present invention, respectively.

EMBODIMENTS OF THE INVENTION

Embodiment

FIGS. 1 to 10 illustrate an embodiment in which the scissors according to the present invention is applied to scissors as a work tool used for cutting not only paper but also various workpieces such as metal plates, resin plates, ropes, and cables. Note that, front and rear, left and right, up and down in this embodiment correspond to the crossing arrows shown in FIGS. 1, 2, 5, and 6 and the indications of front and rear, left and right, up and down indicated near the respective arrows.

Figure 1:
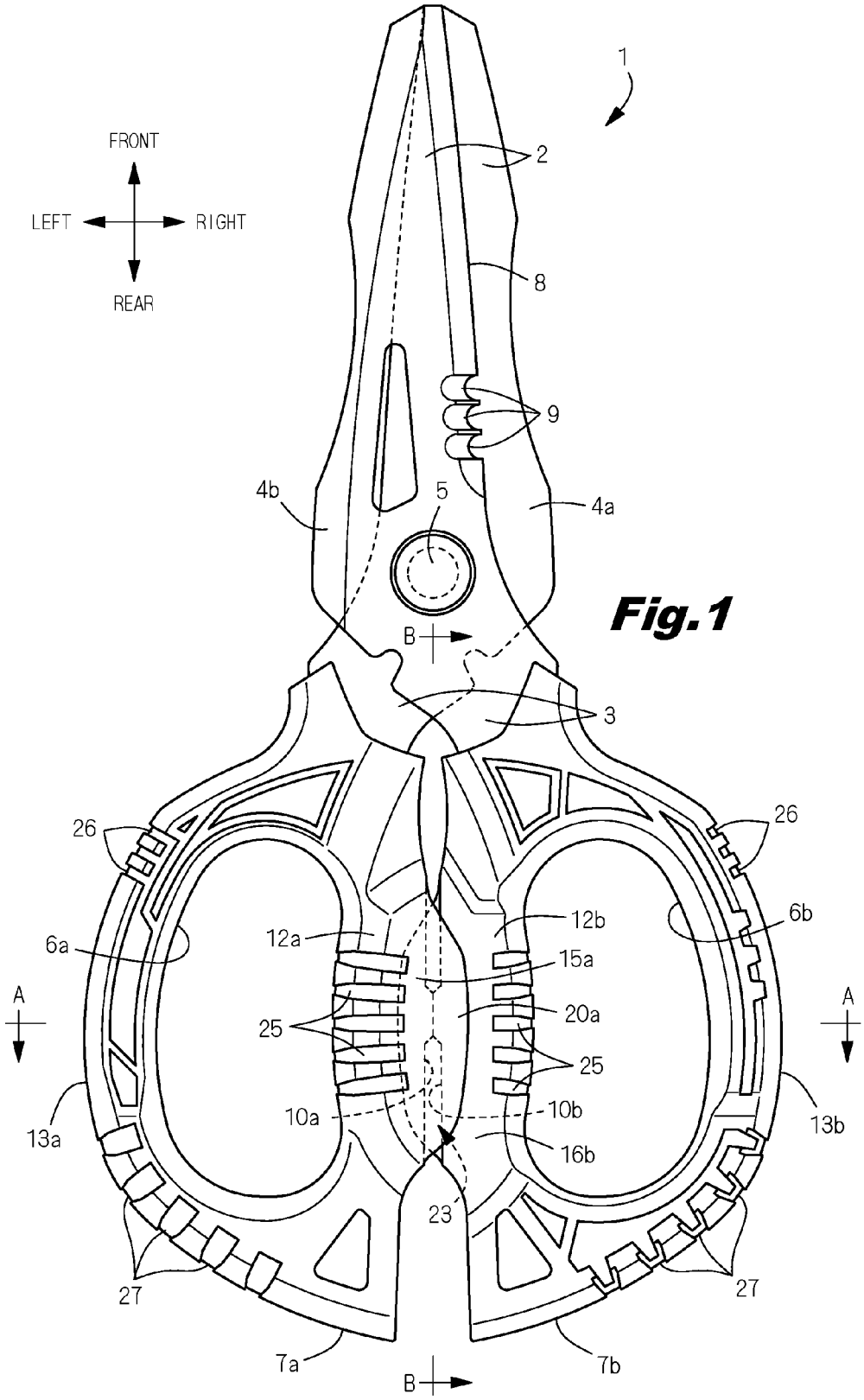
FIG. 1 is a front view of scissors according to the present invention.
Figure 2:
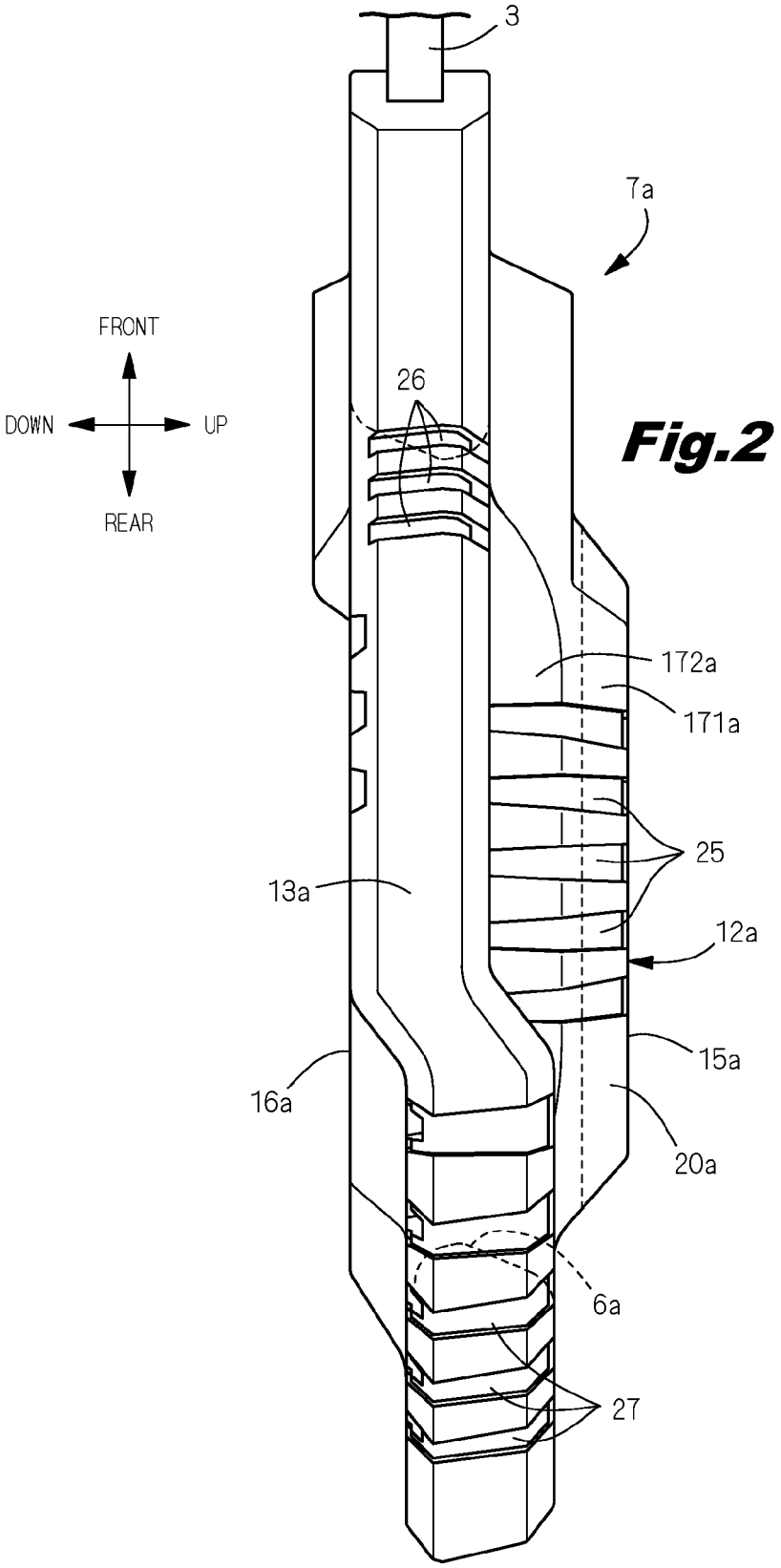
FIG. 2 is a side view of the scissors according to the present invention.
Figure 3:
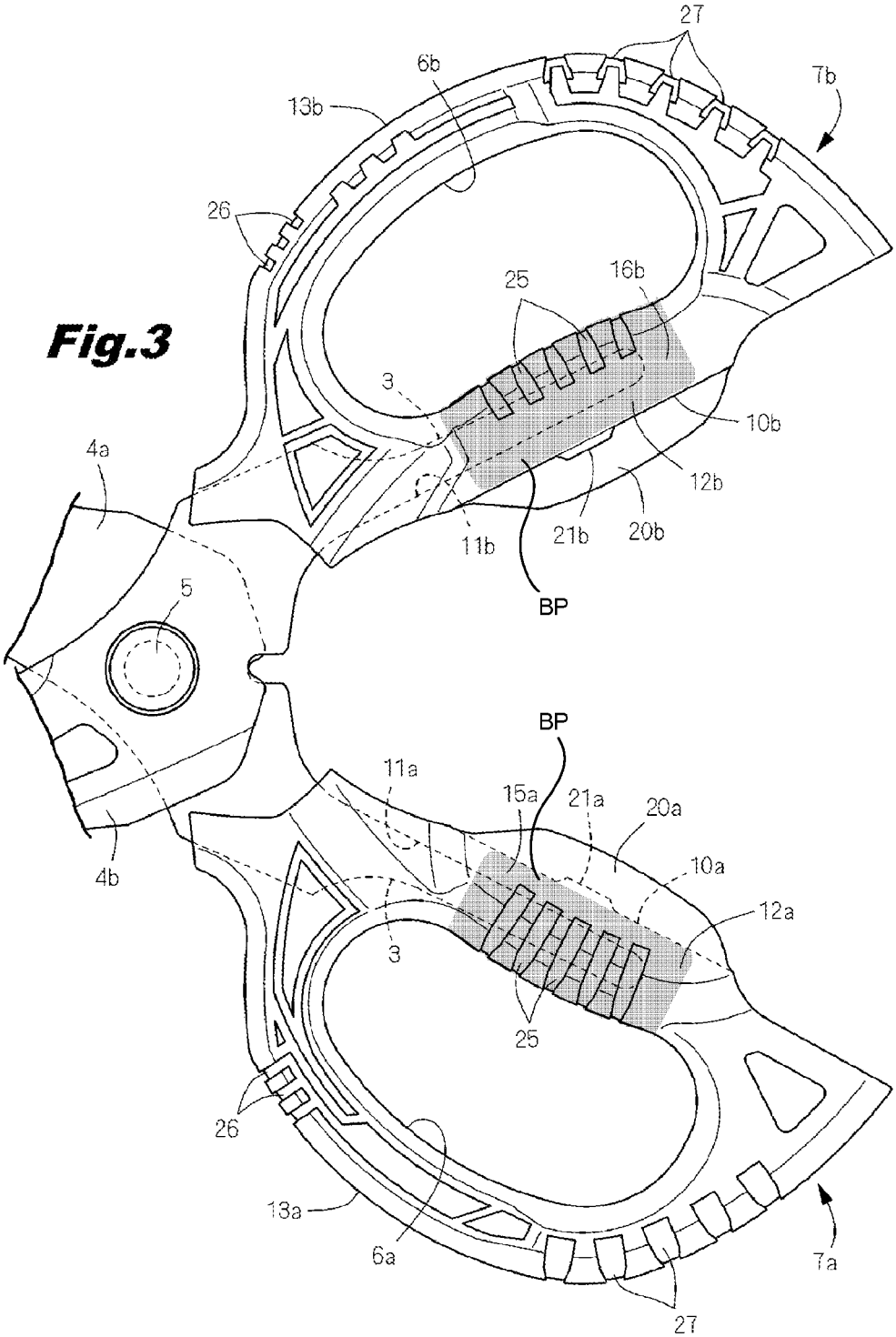
FIG. 3 is a front view of a main portion of the scissors according to the present invention.
Figure 8:
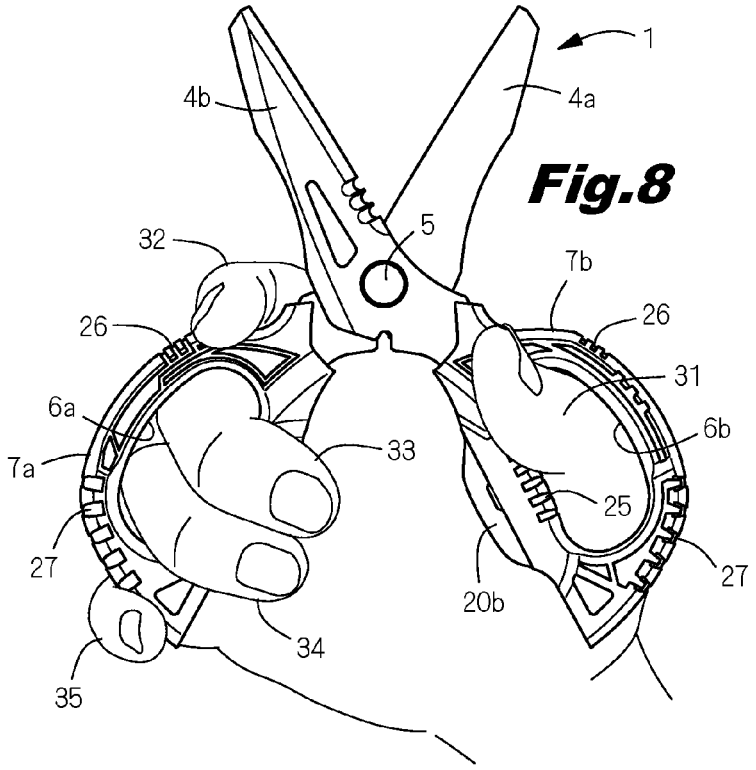
FIG. 8 is a view for describing a use of the scissors according to the present invention.
Figure 9:
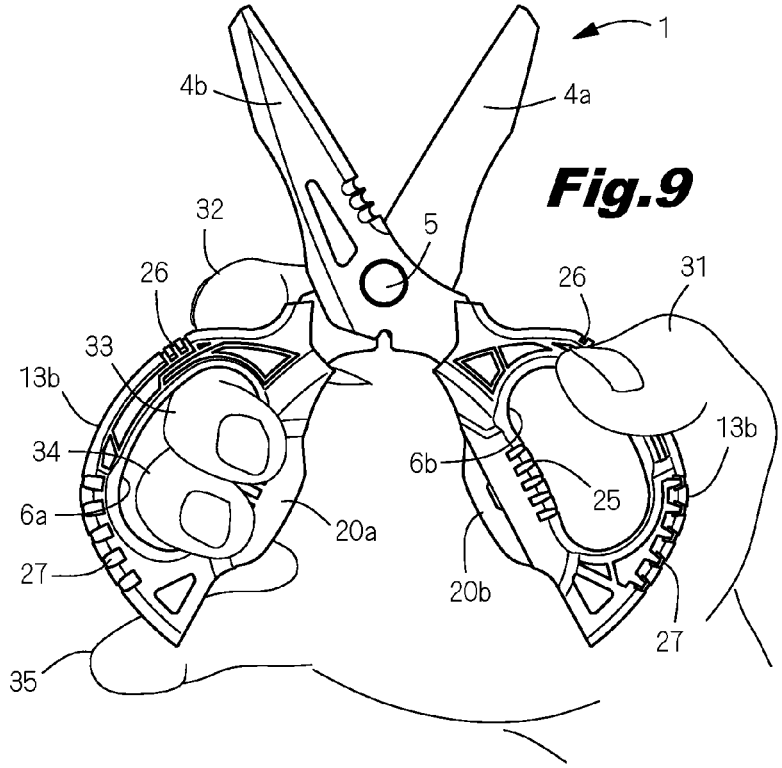
FIG. 9 is a view for describing another use of the scissors according to the present invention.
Figure 10:
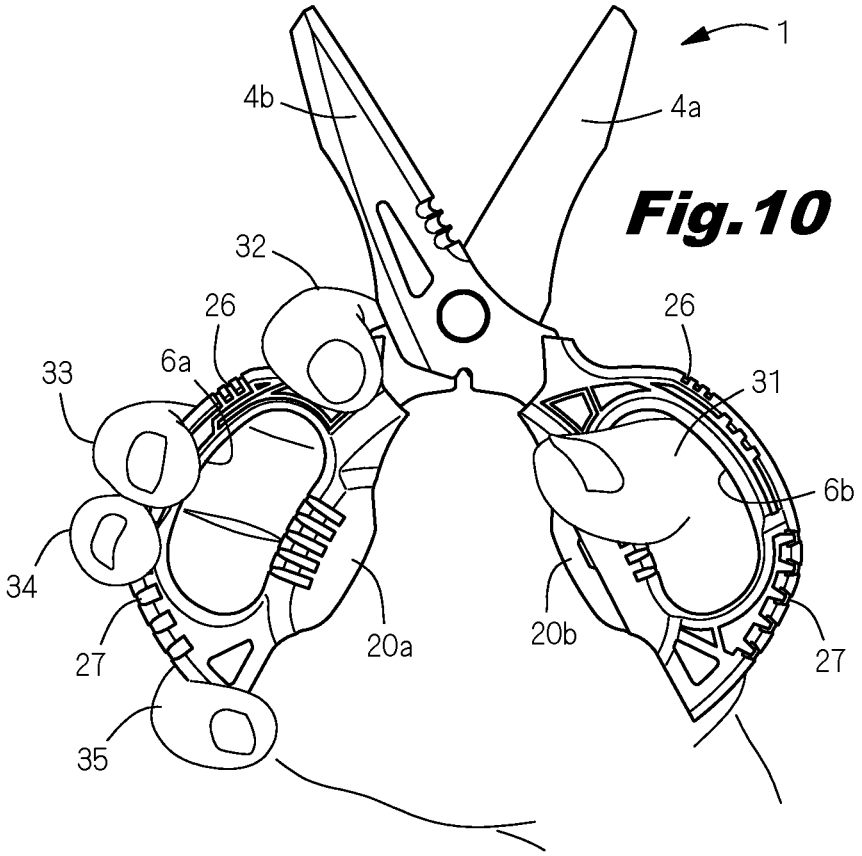
FIG. 10 is a view for describing still another use of the scissors according to the present invention.

As illustrated in FIGS. 1 and 3, the scissors 1 include a pair of upper and lower scissor pieces 4*b*, 4*a* having cutting portions 2 at front ends thereof and handle portions 3 at rear ends thereof, a rotation center shaft 5 provided in center portions in the front and rear directions of the scissor pieces 4*b*, 4*a* so as to crossingly and swingably support the scissor pieces 4*b*, 4*a* with each other, the scissor pieces 4*b*, 4*a* being assembled in an X-shape, and a pair of left and right operation portions 7*a*, 7*b* which are attached to the handle portions 3 of the respective scissor pieces 4*b*, 4*a* and have finger placing holes 6*a*, 6*b* for placing fingertips of a user (refer to FIGS. 8 to 10). As illustrated in FIG. 1, the right operation portion 7*b* is attached to the handle portion 3 of the scissor piece 4*b* which is positioned on an upper side, and the left operation portion 7*a* is attached to the handle portion 3 of the scissor piece 4*a* which is positioned on a lower side.

The operation portions 7*a*, 7*b* are resin-made block bodies, and, with the fingertips placed on the both finger placing holes 6*a*, 6*b*, the both operation portions 7*a*, 7*b* are freely opened and closed about the rotation center shaft 5 between an open position (refer to FIG. 3) in which opposing inner surfaces 10*a*, 10*b* of the both operation portions 7*a*, 7*b* are apart from each other and a closed position (refer to FIG. 1) in which the opposing inner surfaces 10*a*, 10*b* of the both operation portions 7*a*, 7*b* are close to each other. As illustrated in FIG. 3, the cutting portions 2, 2 can be opened by making the both operation portions 7*a*, 7*b* in an open position, and as illustrated in FIG. 1, the cutting portions 2, 2 can be closed by making the both operation portions 7*a*, 7*b* in a closed position. Cutting work can thus be performed on the workpiece.

In FIG. 1, a reference sign 8 denotes cut surfaces provided to the cutting portions 2, 2 of the both scissor pieces 4*b*, 4*a*. On the rear end portion of the cut surface 8 of the upper scissor piece 4*b*, three cutting edges 9 in total for cutting outer coating films and the like of power cables are concavely formed.

The left operation portion 7*a* includes a base block 12*a* having an attachment hole 11*a* to which the handle portion 3 is attached (refer to FIGS. 3, 4A and 4B), and an outer block 13*a* having a substantially semi-circular arc shape connected to the front and rear ends of the base block 12*a*. The left operation portion 7*a* is a resin-molded article formed in a ring shape in plan view by integrally molding the base block 12*a* and the outer block 13*a*. The right operation portion 7*b* is formed symmetrically to the left operation portion 7*a*, and includes a base block 12*b* having an attachment hole 11*b* to which the handle portion 3 is attached, and an outer block 13*b* having a substantially semi-circular arc shape connected to the front and rear ends of the base block 12*b*. The right operation portion 7*b* is a resin-molded article formed in a ring shape in plan view by integrally molding the base block 12*b* and the outer block 13*b*. In the center portions of the left and right operation portions 7*a*, 7*b*, the finger placing holes 6*a*, 6*b* are formed in a long oval shape in the front and rear directions. The inner peripheral edges of the finger placing holes 6*a*, 6*b* are defined by these base blocks 12*a*, 12*b* and outer blocks 13*a*, 13*b*.

Figure 4A:
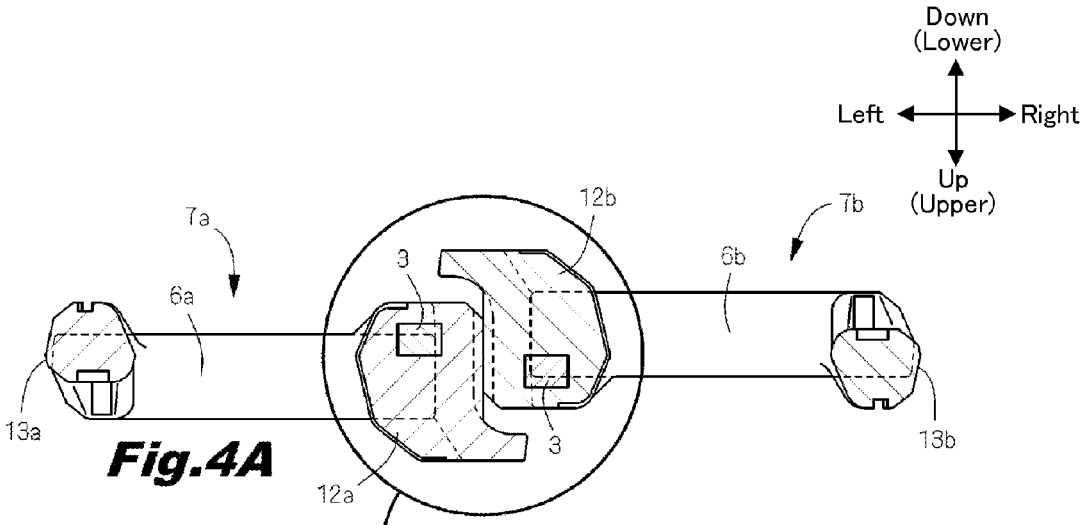
FIGS. 4A and 4B are cross-sectional views taken along line A-A of FIG. 1.
Figure 4B:
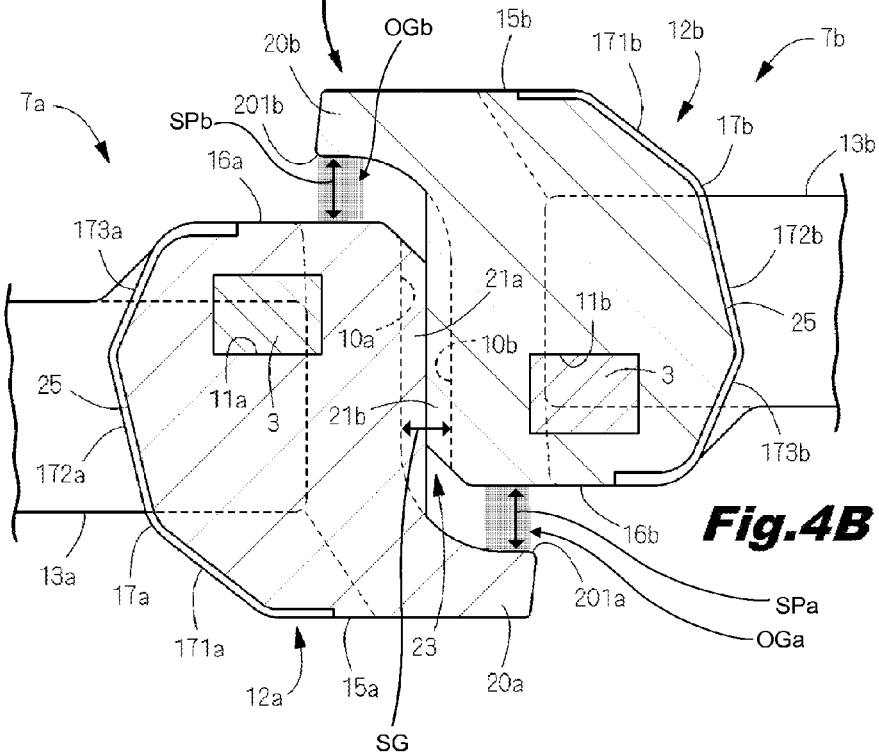

As illustrated in FIGS. 4A and 4B, the base block 12*a* of the left operation portion 7*a* is formed in a cross-sectional polygonal shape having an upper end surface 15*a*, a lower end surface 16*a*, the opposing inner surface 10*a* positioned on the right, and a left side surface 17*a* positioned on the left. At the upper end of the base block 12*a*, a finger pinch prevention guard 20*a* is formed so as to extend in a cantilever manner to the inside in the left and right directions. The base block 12*b* of the right operation portion 7*b* formed symmetrically to the left operation portion 7*a* has a similar shape, and is formed in a cross-sectional polygonal shape having a lower end surface 15*b*, an upper end surface 16*b*, the opposing inner surface 10*b* positioned on the left, and a right side surface 17*b* positioned on the right. At the lower end of the base block 12*b*, a finger pinch prevention guard 20*b* is formed so as to extend in a cantilever manner to the inside in the left and right directions.

As illustrated in FIGS. 4A and 4B, the left side surface 17*a* of the operation portion 7*a* includes a first inclined surface 171*a* which inclines downward to the left continuously to the upper end surface 15*a*, a second inclined surface 172*a* which inclines downward to the left continuously to the first inclined surface 171*a* at a larger inclination angle than that of the first inclined surface 171*a*, and a third inclined surface 173*a* which inclines downward to the right continuously to the second inclined surface 172*a*. Similarly, the right side surface 17*b* of the operation portion 7*b* includes a first inclined surface 171*b* which inclines upward to the right continuously from the lower end surface 15*b*, a second inclined surface 172*b* which inclines upward to the right continuously to the first inclined surface 171*b* at a larger inclination angle than that of the first inclined surface 171*b*, and a third inclined surface 173*b* which inclines upward to the left continuously to the second inclined surface 172*b*.

Figure 5:
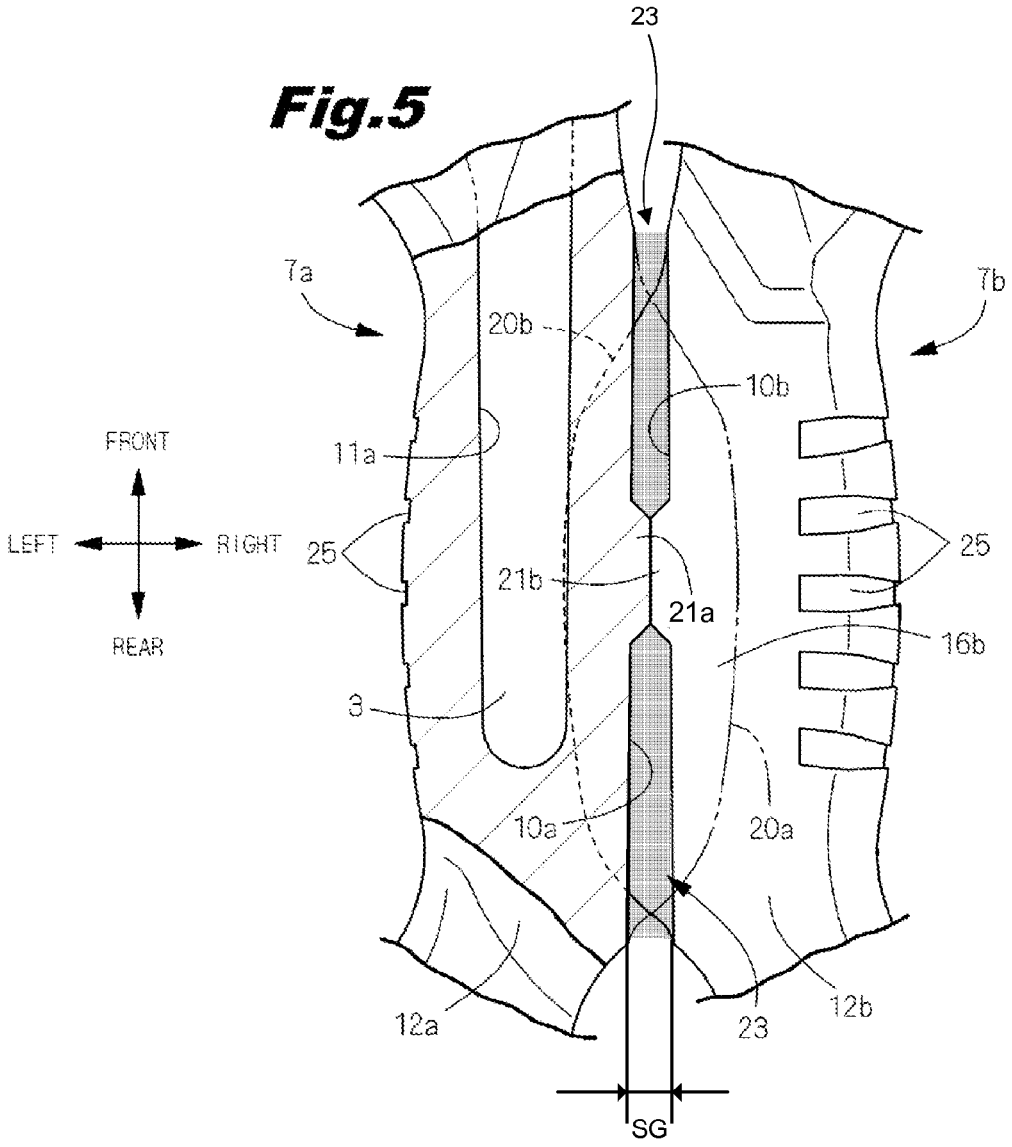
FIG. 5 is a cross-sectional front view of the main portion of the scissors according to the present invention.
Figure 6:
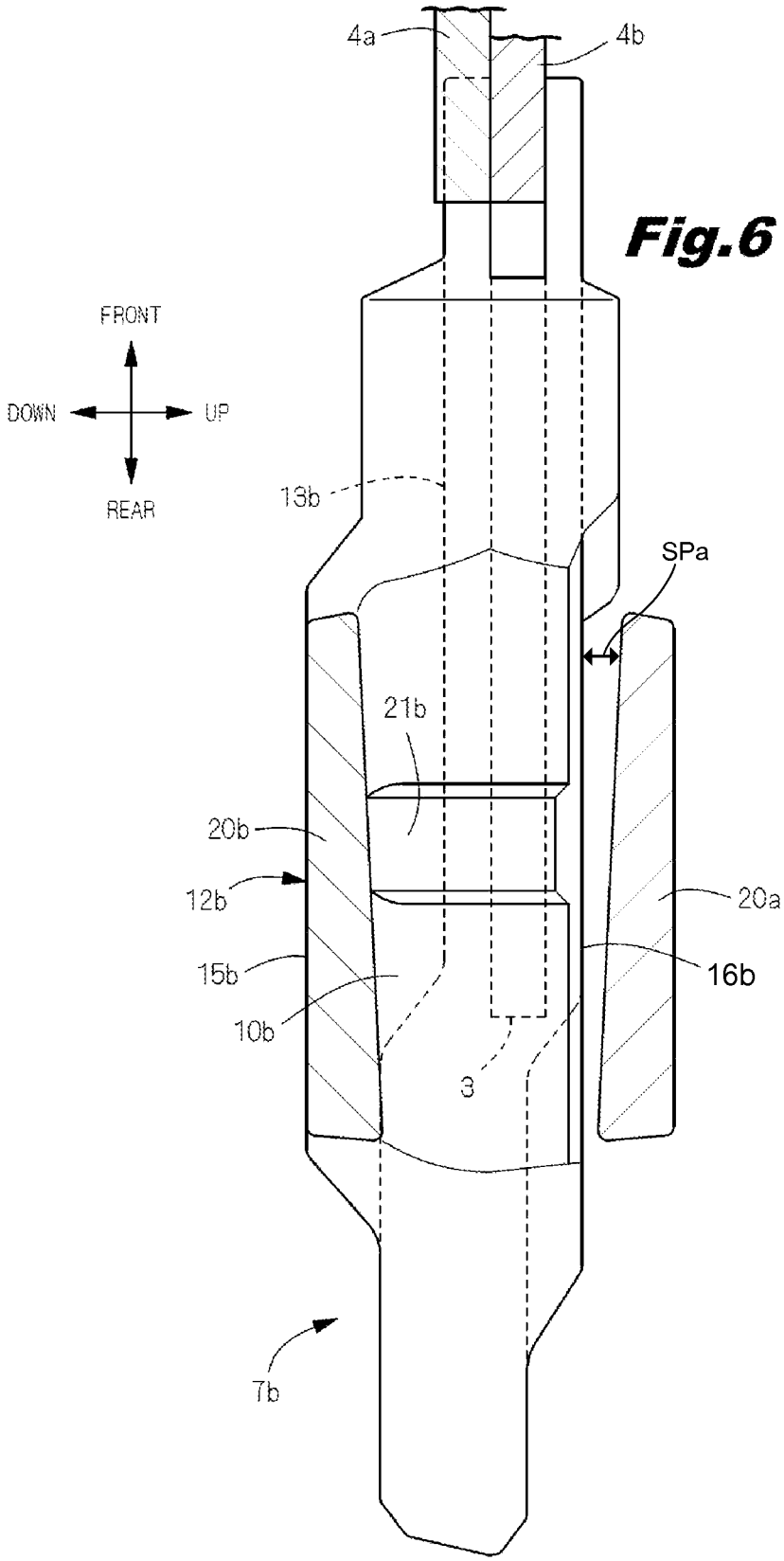
FIG. 6 is a cross-sectional view taken along line B-B of FIG. 1.
Figures 7A, 7B, 7D:
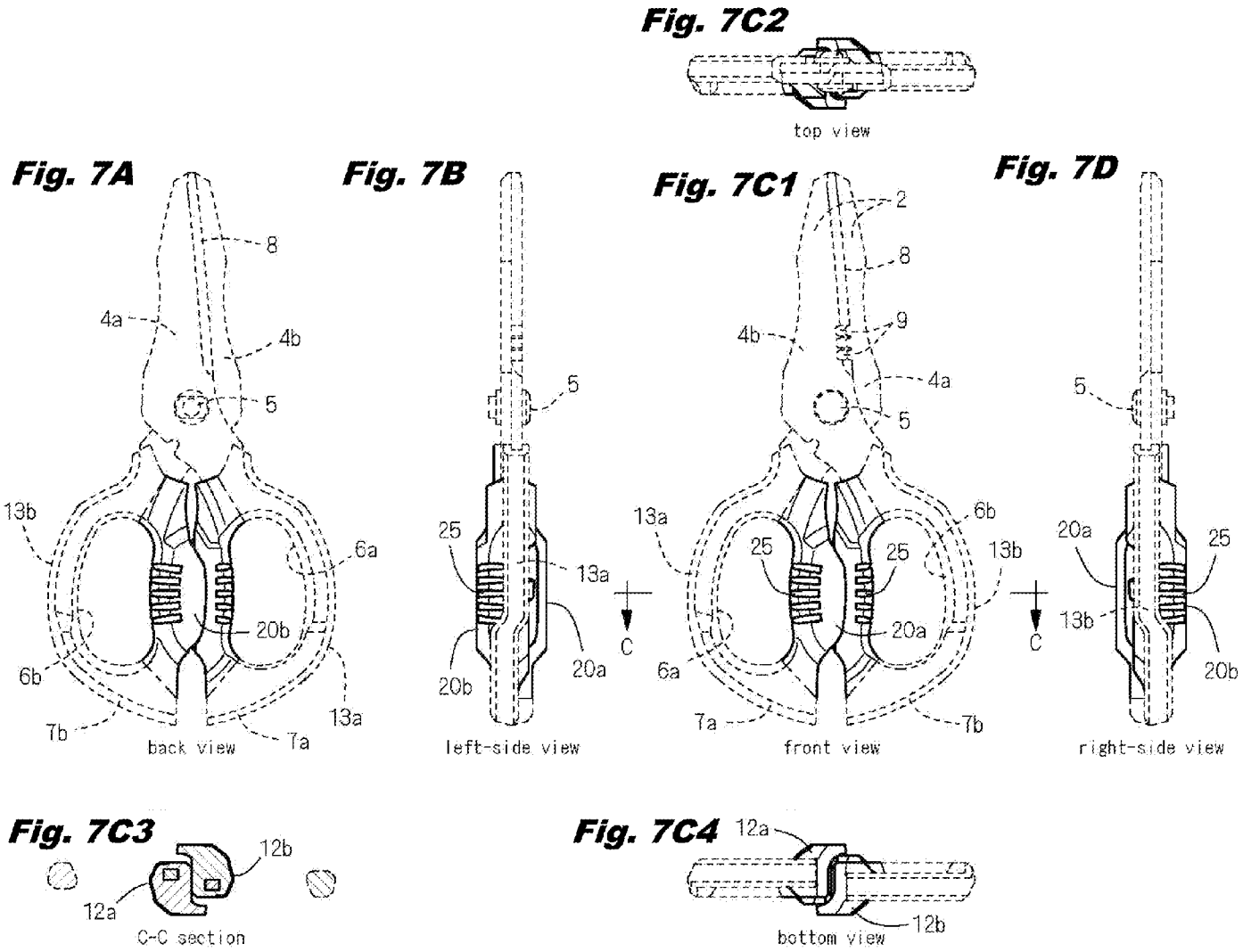

As illustrated in FIGS. 4A, 4B and 5, the opposing inner surfaces 10*a*, 10*b* of the base blocks 12*a*, 12*b* of each operation portion 7*a*, 7*b* are formed of vertical surfaces extending in the vertical direction. In the center portions of the both opposing inner surfaces 10*a*, 10*b* in the front and rear directions, there are formed protruding portions 21*a*, 21*b* for defining the proximity limit of the both operation portions 7*a*, 7*b* in the closed position. As a result, as illustrated in FIG. 5, in the closed position in which the protruding surfaces of the both protruding portions 21*a*, 21*b* make contact with each other, a center gap 23 is formed with a predetermined space SG in the left-right direction between the opposing inner surfaces 10*a*, 10*b* of the both operation portions 7*a*, 7*b* except for a part where the protruding portions 21*a*, 21*b* are formed. The space SG is shown in FIG. 4B as well. In FIG. 5, the center gap 23 is illustrated with two hatched areas, separated by the protruding portions 21*a* and 21*b* in the front-rear direction. In other embodiment, the center gap 23 may not be separated but composed in a single area when the protruding portions 21*a* and 21*b* make two point contacts sandwiching the center gap 23 in the front-rear direction, one contact point being at the far front side, and the other contact point being at the far rear side. When there are two or three different point contacts between them, the center gap 23 may be composed with multiple area corresponding to the number of the contacts.

The above-mentioned finger pinch prevention guards 20*a*, 20*b* are provided for the purpose of preventing fingertips from entering the center gap 23 and being pinched between the opposing inner surfaces 10*a*, 10*b*. As described above, the finger pinch prevention guard 20*a* provided on the left operation portion 7*a* is formed so as to extend in a cantilever manner to the inside in the left and right directions from the upper end of the base block 12*a*. In the closed position, the finger pinch prevention guard 20*a* overlaps with the upper end surface 16*b* of the base block 12*b* of the right operation portion 7*b* with a predetermined space (Spa) in the vertical direction (or the up-down direction) so that an opposing gap OGa is formed between the finger pinch prevention guard 20*a* and the upper end surface 16*b*, to prevent the fingertips from entering the opposing gap 23 from above (refer to FIGS. 4A and 4B). Similarly, the finger pinch prevention guard 20*b* provided on the right operation portion 7*b* is formed so as to extend in a cantilever manner to the inside in the left and right directions from the lower end of the base block 12*b*. In the closed position, the finger pinch prevention guard 20*b* overlaps with the lower end surface 16*a* of the base block 12*a* of the left operation portion 7*a* with a predetermined space (SPb) in the vertical direction (or the up-down direction) so that another opposing gap OGb is formed between the finger pinch prevention guard 20*b* and the lower end surface 16*a*, to prevent the fingertips from entering the opposing gap 23 from below. These gaps OGa and OGb are shown as hatched area in FIG. 4B. The upper surface of the finger pinch prevention guard 20*a* is formed so as to be flush with the upper end surface 15*a*, and the lower surface of the finger pinch prevention guard 20*b* is formed so as to be flush with the lower end surface 15*b*.

More specifically, as illustrated in FIG. 8, usually, when a user uses the scissors 1 according to this embodiment, a middle finger 33 and a third finger 34 are inserted into the finger placing hole 6*a* of the left operation portion 7*a*, and a thumb 31 is inserted into the finger placing hole 6*b* of the right operation portion 7*b*. An index finger 32 and a little finger 35 are set along the outer circumferential edge of the outer block 13*a* of the operation portion 7*a*. Then, by operating a thumb 31 close to or away from the middle finger 33 and the third finger 34, the operation portions 7*a*, 7*b* are operated between the closed position and the open position to open and close the scissor pieces 4*a*, 4*b*. Accordingly, when the middle finger 33 and the third finger 34 inserted into the finger placing hole 6*a* are largely bent at the first joints to reach the opposing inner surface 10*a* (refer to FIG. 3), fingertips of the middle finger 33 and/or the third finger 34 may be pinched between the opposing inner surfaces 10*a*, 10*b* or between the protruding portions 21*a*, 21*b* to cause finger pinch when the operation portions 7*a*, 7*b* are in the closed position. Therefore, in the scissors 1 according to this embodiment, the finger pinch prevention guards 20*a*, 20*b* are formed so as to extend into the inside in the left and right directions on the base blocks 12*a*, 12*b* of the operation portions 7*a*, 7*b*, and the fingertips of the middle finger 33 and the third finger 34 are set along the surfaces of the finger pinch prevention guards 20*a*, 20*b*, whereby fingertips of the middle finger 33 and the third finger 34 are prevented from being pinched between the opposing inner surfaces 10*a*, 10*b* or between the protruding portions 21*a*, 21*b*. In other words, the finger pinch prevention guards 20*a*, 20*b* prevent the fingertips of the middle finger 33 and the third finger 34 from being largely bent at the first joints and reaching the opposing inner surfaces 10*a*, 10*b*, whereby the fingertips are prevented from being pinched between the opposing inner surfaces 10*a*, 10*b* or between the protruding portions 21*a*, 21*b*. Note that, since the thumb 31 as the first finger has fewer joints than other fingers such as the middle finger 33, the thumb 31 rarely reaches the opposing inner surfaces 10*a*, 10*b* and is unlikely to be pinched between the opposing inner surfaces 10*a*, 10*b*.

Further, in the scissors 1 according to this embodiment, the outer shapes of the left and right finger placing holes 6*a*, 6*b* are substantially the same. Thus, as shown in FIG. 8, it is possible to employ a mode in which the middle finger 33 and the third finger 34 are inserted into the left finger placing hole 6*a* to use the scissors 1, and to employ a mode in which the middle finger 33 and the third finger 34 are inserted into the right finger placing hole 6*b* to use the scissors 1. Therefore, when the finger pinch prevention guards 20*a*, 20*b* are provided to both of the left and right operation portions 7*a*, 7*b* as in this embodiment, finger pinch can be reliably prevented even if either of the above described modes for using the scissors 1 is employed. This means that finger pinch can be prevented even if a user inserts the middle finger 33 and the third finger 34 into either of the finger placing holes 6*a*, 6*b* of the left and right operation portions 7*a*, 7*b*. Thus, it is possible to provide the scissors 1 with excellent usability eliminating a difference of usage between the left and the right. On the other hand, in a mode in which the finger pinch prevention guard 20*a*, 20*b* is provided to only one of the left and right operation portions 7*a*, 7*b*, a user has to choose either of the finger placing holes 6*a*, 6*b* into which the middle finger 33 and the like should be inserted, thereby causing lowering of usability of the scissors 1.

Further, in the scissors 1 according to this embodiment, in addition to providing the finger pinch prevention guards 20*a*, 20*b* as described above, various measures for preventing finger pinch have been taken. Specifically, the upper and lower end surfaces 16*a*, 16*b* opposite to the finger pinch prevention guards 20*a*, 20*b* in the closed position are flat surfaces. That is, the upper end surface 16*b* of the base block 12*b* of the right operation portion 7*b* opposite to the finger pinch prevention guard 20*a* of the left operation portion 7*a* is a flat surface, and in addition, the lower end surface 16*a* of the base block 12*a* of the left operation portion 7*a* opposite to the finger pinch prevention guard 20*b* of the right operation portion 7*b* is a flat surface. In this way, when the upper and lower end surfaces 16*a*, 16*b* opposite to the finger pinch prevention guards 20*a*, 20*b* in the closed position are flat surfaces, the fingertips of the middle finger 33 and the like can be reliably prevented from being pinched between the upper and lower end surfaces 16*a*, 16*b* as the flat surfaces and the tip end portions of the finger pinch prevention guards 20*a*, 20*b*. That is, for example, when a recessed portion for receiving the finger pinch prevention guards 20*a*, 20*b* is formed on the upper and lower end surfaces 16*a*, 16*b* opposite to the finger pinch prevention guards 20*a*, 20*b* of the base blocks 12*a*, 12*b* in order to reduce the thickness of the base blocks 12*a*, 12*b*, the fingertips of the middle finger 33 and the like may be pinched between the side surface of such a recessed portion and the tip end portions of the finger pinch prevention guards 20*a*, 20*b*. On the other hand, when the upper and lower end surfaces 16*a*, 16*b* opposite to the finger pinch prevention guards 20*a*, 20*b* in the closed position are formed in flat surfaces as in this embodiment, even if the fingertips of the middle finger 33 and the like are placed on the upper and lower end surfaces 16*a*, 16*b* opposite to the finger pinch prevention guards 20*a*, 20*b*, the fingertips slide on the surfaces of the upper and lower end surfaces 16*a*, 16*b* in accordance with closing operation of the operation portions 7*a*, 7*b*. Therefore, a trouble that the fingertips of the middle finger 33 and the like are pinched between the upper and lower end surfaces 16*a*, 16*b* and the tip end portions of the finger pinch prevention guards 20*a*, 20*b* does not occur, and finger pinch can be reliably prevented.

Further, as illustrated in FIGS. 4A and 4B, in this embodiment, corner portions 201*a*, 201*b* opposite to the upper and lower end surfaces 16*a*, 16*b* of the tip end portions of the finger pinch prevention guards 20*a*, 20*b* are formed as curved surfaces. In this way, when the corner portions 201*a*, 201*b* opposite to the upper and lower end surfaces 16*a*, 16*b* of the tip end portions of the finger pinch prevention guards 20*a*, 20*b* are formed as the curved surfaces, the fingertips can be more reliably prevented from being hurt.

Further, in this embodiment, as illustrated in FIGS. 1, 3, and 8, anti-slipping recess and projection portions 25 (or inner recess and projection portions 25) are formed on contact points with the fingertips of the middle finger 33, the third finger 34, the thumb 31, and the like which are inserted into the finger placing holes 6*a*, 6*b*. Accordingly, by placing the fingertips of the middle finger 33 and the like on the recess and projection portions 25, the state where the middle finger 33 and the like are inserted into the finger placing holes 6*a*, 6*b* can be more reliably maintained. Therefore, the fingertips can be prevented from reaching the opposing inner surfaces 10*a*, 10*b* by a careless sliding movement of the middle finger 33 or the like, and the fingertips can be prevented from being pinched between the opposing inner surfaces 10*a*, 10*b* or between the protruding portions 21*a* and 21*b*. In this embodiment, as illustrated in FIGS. 4A and 4B, the recess and projection portions 25 are formed by arranging, along the front and rear directions, a plurality of recessed portions on the left side surface 17*a* including the first inclined surface 171*a*, the second inclined surface 172*a*, and the third inclined surface 173*a*, of the operation portion 7*a* and on the right side surface 17*b* including the first inclined surface 171*b*, the second inclined surface 172*b*, and the third inclined surface 173*b*, of the operation portion 7*b*.

The scissors according to this embodiment can employ a use mode as illustrated in FIGS. 9 and 10 other than the use mode illustrated in FIG. 8. The use mode illustrated in FIG. 9 differs from the use mode illustrated in FIG. 8 in that, rather than inserting the thumb 31 into the right finger placing hole 6*b*, the thumb 31 is placed on the outer peripheral edge of the outer block 13*b* of the right operation portion 7*b*. In order to adapt to the above described use mode, in this embodiment, anti-slipping recess and projection portions 26 (or front recess and projection portions 26) are formed on contact points with the thumb 31 at the front of the outer blocks 13*a*, 13*b*. In this way, when closing the operation portions 7*a*, 7*b* by placing the thumb 31 on the outer peripheral edge of the outer block 13*b*, the gap between the thumb 31 and the middle and third fingers 33 and 34 can be made larger as compared to the use mode illustrated in FIG. 8. Therefore, the closing operation (cutting operation) can be performed by applying larger force to the operation portions 7*a*, 7*b*. Further, since the anti-slipping recess and projection portions 26 are formed on the outer blocks 13*a*, 13*b* corresponding to the contact points with the thumb 31, it is possible to effectively prevent the thumb 31 from sliding carelessly even when such a use mode is employed.

The use mode illustrated in FIG. 10 differs from the use mode illustrated in FIG. 8 in that the thumb 31 is inserted into the finger placing hole 6*b* of the right operation portion 7*b*, and four fingers, from the index finger 32 to the little finger 35, are placed on the outer peripheral edge of the outer block 13*a* of the operation portion 7*a*. In order to adapt to the above described use mode, in this embodiment, anti-slipping recess and projection portions 27 (or rear recess and projection portions 27) are formed on contact points with the third finger 34 at the rear of the outer block 13*a*. In this way, even when closing operation is performed to the operation portions 7*a*, 7*b* with the four fingers, from the index finger 32 to the little finger 35, placed on the outer peripheral edge of the outer blocks 13*a*, 13*b*, the gap between the middle finger 33 and the third finger 34, and the thumb 31 can be made larger as compared to the use mode illustrated in FIG. 8, similar to the use mode illustrated in FIG. 9. Therefore, the closing operation (cutting operation) can be performed by applying larger force to the operation portions 7*a*, 7*b*. Further, since the anti-slipping recess and projection portions 27 are formed on the contact points with the third finger 34 and the like, the third finger 34 and the like can be effectively prevented from sliding carelessly even when the use mode is employed.

The shapes and the like of the operation portions 7*a*, 7*b* of the scissors according to the present invention are not limited to those shown in the above embodiment. For example, the recess and projection portions 26, 27 of the outer blocks 13*a*, 13*b* are not always necessary, as long as the finger pinch prevention guards 20*a*, 20*b* are formed on the operation portions 7*a*, 7*b*. In the above-described embodiment, the protruding portions 21*a*, 21*b* are formed on the opposing inner surfaces 10*a*, 10*b* of the both operation portions 7*a*, 7*b*. However, the present invention is not limited thereto, and the protruding portion 21*a*, 21*b* may be formed only on the opposing inner surface 10*a*, 10*b* of one operation portion 7*a*, 7*b*, and the center gap 23 may be formed by the tip end of one protruding portion 21*a*, 21*b* making contact with the opposing inner surface 10*a*, 10*b*.

DESCRIPTION OF REFERENCE SIGNS

1: scissors
2: cutting portion
3: handle portion
4*a*, 4*b*: scissor piece
5: rotation center shaft
6*a*, 6*b*: finger placing hole
7*a*, 7*b*: operation portion
20*a*, 20*b*: finger pinch prevention guard
21*a*, 21*b*: protruding portion
23: center gap
25: inner recess and projection portion (or anti-slipping recess and projection portion)

The invention claimed is:

1. Scissors comprising:

a pair of upper and lower scissor pieces having cutting portions at front ends thereof and handle portions at rear ends thereof;

a rotation center shaft provided in center portions in a front-rear direction of the scissor pieces so as to crossingly and swingably support the scissor pieces with each other, the scissor pieces being assembled in an X-shape, the rotation center shaft being oriented to an up-down direction that is perpendicular to the front-rear direction; and a pair of left and right operation portions (7*a*, 7*b*) attached to the handle portions of the scissor pieces and having left and right placing holes (6*a*, 6*b*) for placing fingertips of a user, the left operation portion (7*a*) with the left finger placing hole (6*a*) being connected to the lower scissor piece (4*a*) and the right operation portion (7*b*) with the right finger placing hole (6*b*) being connected to the upper scissor piece (4*b*), wherein with the fingertips placed on the finger placing holes, the cutting portions are opened and closed by opening and closing the both operation portions about the rotation center shaft between an open position in which opposing inner surfaces of the both operation portions are apart from each other and a closed position in which the opposing inner surfaces of the both operation portions are close to each other, left and right finger pinch prevention guards (20*a*, 20*b*) are respectively provided on the left and right operation portions, the left finger pinch prevention guard being formed on an upper end of the left operation portion, extending in a cantilever manner toward the right finger placing hole, and the right finger pinch prevention guard being formed on a lower end of the right operation portion, extending in a cantilever manner toward the left finger placing hole, and the left and right finger pinch prevention guards being respectively overlapped with an upper end surface (16*b*) of the right operation portion and a lower end surface (16*a*) of the left operation portions when the both operation portions are in the closed position, an opposing gap (OGa) having a predetermined space (SPa) is formed in the up-down direction between the left finger pinch prevention guard (20*a*) and the upper end surface (16*b*), and another opposing gap (OGb) having a predetermined space (SPb) is formed in the same direction as the opposing gap between the right finger pinch prevention guard (20*b*) and the lower end surface (16*a*), the upper end surface of the right operation portion and the lower end surface of the left operation portion are opposed to the finger pinch prevention guards when the both operation portions are in the closed position, and due to the opposing gap and the another opposing gap, the finger pinch prevention guards and the upper end surface and the lower end surface of the right and left operation portions opposed to the finger pinch prevention guards do not make contact with each other when the both operation portions are in the closed position.

2. The scissors according to claim 1, wherein the upper end surface and the lower end surface of the operation portions opposed to the finger pinch prevention guards in the closed position are flat surfaces.

3. The scissors according to claim 1, wherein anti-slipping recess and projection portions (25) are formed on base end portions (BP) of the operation portions of the finger pinch prevention guards, the base end portions being defined as regions where the fingertips of the user placed inside the finger placing holes are hooked.

4. The scissors according to claim 1, wherein protruding portions for restricting a proximity limit of the both operation portions in the closed position are formed on one or both of the opposing inner surfaces of the both operation portions, a center gap (23) is formed between the operation portions in the closed position with a predetermined space (SG) in a left-right direction, which is perpendicular to the up-down direction and the front-rear direction, by the protruding portions making contact with each other or by tip ends of the protruding portions making contact with the opposing inner surfaces, and the finger pinch prevention guards are capable of preventing the fingertips from entering the center gap from above and below when the both operation portions are in the closed position.

5. The scissors according to claim 2, wherein protruding portions for restricting a proximity limit of the both operation portions in the closed position are formed on one or both of the opposing inner surfaces of the both operation portions, a center gap (23) is formed between the operation portions in the closed position with a predetermined space (SG) in a left-right direction, which is perpendicular to the up-down direction and the front-rear direction, by the protruding portions making contact with each other or by tip ends of the protruding portions making contact with the opposing inner surfaces, and the finger pinch prevention guards are capable of preventing the fingertips from entering the center gap from above and below when the both operation portions are in the closed position.

6. The scissors according to claim 3, wherein protruding portions for restricting a proximity limit of the both operation portions in the closed position are formed on one or both of the opposing inner surfaces of the both operation portions, a center gap (23) is formed between the operation portions in the closed position with a predetermined space (SG) in a left-right direction, which is perpendicular to the up-down direction and the front-rear direction, by the protruding portions making contact with each other or by tip ends of the protruding portions making contact with the opposing inner surfaces, and the finger pinch prevention guards are capable of preventing the fingertips from entering the center gap from above and below when the both operation portions are in the closed position.

7. Scissors comprising:

a pair of upper and lower scissor pieces having cutting portions at front ends thereof and handle portions at rear ends thereof;

a rotation center shaft provided in center portions in a front-rear direction of the scissor pieces so as to crossingly and swingably support the scissor pieces with each other, the scissor pieces being assembled in an X-shape, the rotation center shaft being oriented to an up-down direction that is perpendicular to the front-rear direction; and a pair of left and right operation portions (7*a*, 7*b*) attached to the handle portions of the scissor pieces and having left and right finger placing holes (6*a*, 6*b*) for placing fingertips of a user, the left operation portion (7*a*) with the left finger placing hole (6*a*) being connected to the upper scissor piece (4*b*) and the right operation portion (7*b*) with the right finger placing hole (6*b*) being connected to the lower scissor piece (4*a*), wherein with the fingertips placed on the finger placing holes, the cutting portions are opened and closed by opening and closing the both operation portions about the rotation center shaft between an open position in which opposing inner surfaces of the both operation portions are apart from each other and a closed position in which the opposing inner surfaces of the both operation portions are close to each other, left and right finger pinch prevention guards are respectively provided on the left and right operation portions, the left finger pinch prevention guard being formed on a lower end of the left operation portion, extending in a cantilever manner toward the right finger placing hole, the right finger pinch prevention guard being formed on an upper end of the right operation portion, extending in a cantilever manner toward the left finger placing hole, and the left and right finger pinch prevention guards being respectively overlapped with a lower end surface of the right operation portion and an upper end surface of the left operation portion when the both operation portions are in the closed position, an opposing gap having a predetermined space is formed in the up-down direction between the left finger pinch prevention guard and the lower end surface, and another opposing gap having a predetermined space is formed in the same direction as the opposing gap between the right finger pinch prevention guard and the upper end surface, the lower end surface of the right operation portion and the upper end surface of the left operation portion are opposed to the finger pinch prevention guards when the both operation portions are in the closed position, and due to the opposing gap and the another opposing gap, the finger pinch prevention guards and the lower end surface and the upper end surface of the right and left operation portions opposed to the finger pinch prevention guards do not make contact with each other when the both operation portions are in the closed position.

8. The scissors according to claim 7, wherein the upper end surface and the lower end surface of the operation portions opposed to the finger pinch prevention guards in the closed position are flat surfaces.

9. The scissors according to claim 7, wherein anti-slipping recess and projection portions are formed on base end portions (BP) of the operation portions of the finger pinch prevention guards, the base end portions being defined as regions where the fingertips of the user placed inside the finger placing holes are hooked.

10. The scissors according to claim 7, wherein protruding portions for restricting a proximity limit of the both operation portions in the closed position are formed on one or both of the opposing inner surfaces of the both operation portions, a center gap is formed between the operation portions in the closed position with a predetermined space in a left-right direction, which is perpendicular to the up-down direction and the front-rear direction, by the protruding portions making contact with each other or by tip ends of the protruding portions making contact with the opposing inner surfaces, and the finger pinch prevention guards are capable of preventing the fingertips from entering the center gap from above and below when the both operation portions are in the closed position.

11. The scissors according to claim 8, wherein protruding portions for restricting a proximity limit of the both operation portions in the closed position are formed on one or both of the opposing inner surfaces of the both operation portions, a center gap is formed between the operation portions in the closed position with a predetermined space in a left-right direction, which is perpendicular to the up-down direction and the front-rear direction, by the protruding portions making contact with each other or by tip ends of the protruding portions making contact with the opposing inner surfaces, and the finger pinch prevention guards are capable of preventing the fingertips from entering the center gap from above and below when the both operation portions are in the closed position.

12. The scissors according to claim 9, wherein protruding portions for restricting a proximity limit of the both operation portions in the closed position are formed on one or both of the opposing inner surfaces of the both operation portions, a center gap is formed between the operation portions in the closed position with a predetermined space in a left-right direction, which is perpendicular to the up-down direction and the front-rear direction, by the protruding portions making contact with each other or by tip ends of the protruding portions making contact with the opposing inner surfaces, and the finger pinch prevention guards are capable of preventing the fingertips from entering the center gap from above and below when the both operation portions are in the closed position.

* * * * *